United States Patent [19]

Ayers et al.

[11] Patent Number: 4,774,975

[45] Date of Patent: Oct. 4, 1988

[54] METHOD AND APPARATUS FOR PROVIDING OSCILLATING CONTAMINANT-REMOVAL STREAM

[75] Inventors: David L. Ayers, Churchill Boro, Pa.; Terry Wright, Birmingham, Ala.; Michael C. Skriba, Plum Boro, Pa.

[73] Assignee: Westinghouse Electric Corp., Pittsburgh, Pa.

[21] Appl. No.: 651,398

[22] Filed: Sep. 17, 1984

[51] Int. Cl.[4] ..... B08B 3/10

[52] U.S. Cl. ..... 134/168 C; 134/172; 134/198; 137/835; 239/589; 239/102.1

[58] Field of Search ..... 134/172, 198, 166 C, 134/167 C, 168 C; 239/102, 589; 137/835

[56] References Cited

U.S. PATENT DOCUMENTS

| | | | |
|---|---|---|---|
| 929,198 | 7/1909 | Doble et al. . | |
| 1,068,438 | 7/1913 | Magee . | |
| 1,101,545 | 6/1914 | Higgins . | |
| 1,694,346 | 12/1928 | Radway . | |
| 3,030,979 | 4/1962 | Reilly | 137/835 |
| 3,273,377 | 9/1966 | Testerman et al. | 137/835 X |
| 3,504,691 | 4/1970 | Campagnuolo et al. | 137/835 X |
| 3,545,467 | 12/1970 | Kwok et al. | 137/835 X |
| 3,563,462 | 2/1971 | Bauer . | |
| 3,668,869 | 6/1972 | De Corso et al. . | |
| 3,970,249 | 7/1976 | Singer . | |
| 3,998,386 | 12/1976 | Viets et al. | 239/102 |
| 4,122,845 | 10/1978 | Stouffer et al. . | |
| 4,157,161 | 6/1979 | Bauer | 137/835 X |
| 4,184,638 | 1/1980 | Ogasawara et al. | 239/589 X |
| 4,227,550 | 10/1980 | Bauer et al. | 134/198 X |
| 4,231,519 | 11/1980 | Bauer | 239/589 X |
| 4,276,856 | 7/1981 | Dent et al. . | |
| 4,355,949 | 10/1982 | Bailey . | |
| 4,424,769 | 1/1984 | Charamathieu et al. . | |
| 4,508,267 | 4/1985 | Stouffer | 137/835 X |

FOREIGN PATENT DOCUMENTS 1246801 9/1971 United Kingdom ..... 137/835

OTHER PUBLICATIONS

Smoot, L. D., "Turbulent Mixing Coefficient for Compressible Coaxial Submerged and Co-Flowing Jets," *AIAA Journal*, vol. 14, No. 2, Nov. 1976, pp. 1699–1705.

Quinn, B., "Compact Ejector Thrust Augmentation," *Journal of Aircraft*, vol. 10, No. 3, Aug. 1973, pp. 481–486.

Viets, H., "Flip-Flop Jet Nozzle," *AIAA Journal*, vol. 13, No. 10, Oct. 1975, pp. 1375–1379.

Platzer, M. F. (et al.), "Entrainment Characteristics of Unsteady Subsonic Jets," *AIAA Journal*, vol. 16, No. 3, Mar. 1978, pp. 282–284.

Baladi, J. Y., Wright, T., "A Literature Survey on Confined Jets," Westinghouse Research Memo (in publication), Fluid Systems Laboratory.

*Primary Examiner*—Harvey C. Hornsby
*Assistant Examiner*—Frankie L. Stinson

[57] ABSTRACT

For removal of the contaminant deposits from a surface such as a tube sheet of a vertical tube heat exchanger, as in a nuclear steam generator, having plural spaced heat exchange tubes connected to the tube sheet, a lance is radially moved along the tube sheet between parallel rows of tubes. The lance carries a nozzle for ejecting a stream of high pressure cleaning fluid toward the sludge deposits, the nozzle acting cyclically to sweep the stream throughout a range of directions centered about the nozzle axis. The nozzle may include diverting streams for deflecting the cleaning fluid stream, with the diverting streams either being generated by a fluidic oscillator or being fed back from the outlet portion of the nozzle. Alternatively, pivoting vane means may be provided in the nozzle to divert the cleaning fluid stream.

6 Claims, 2 Drawing Sheets

Fig 3
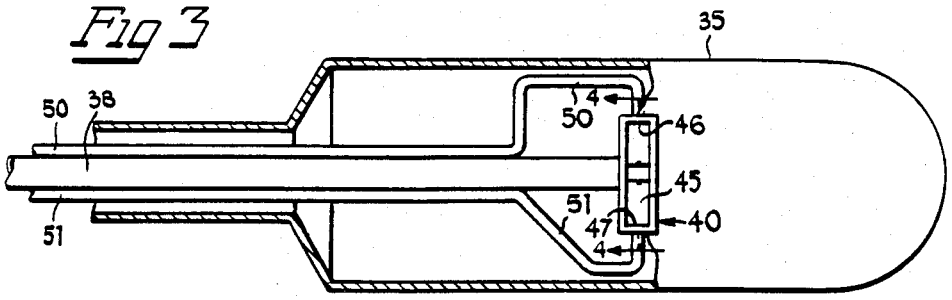
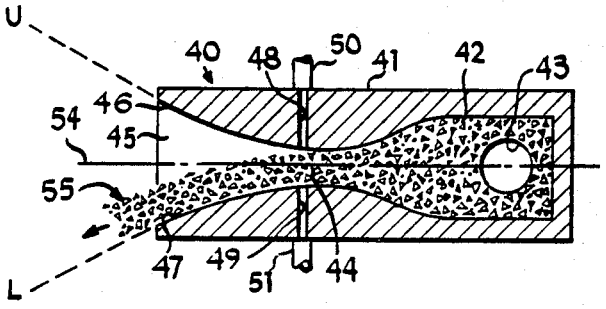
Fig 4
Fig 6
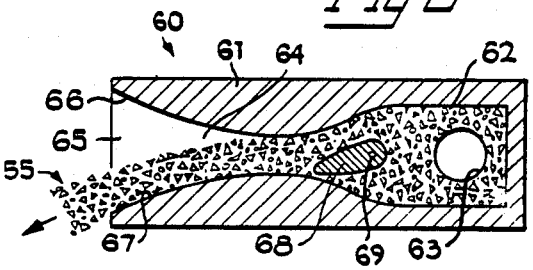
Fig 5
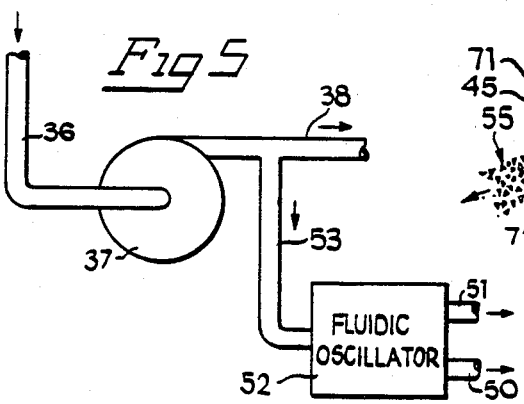
Fig 7
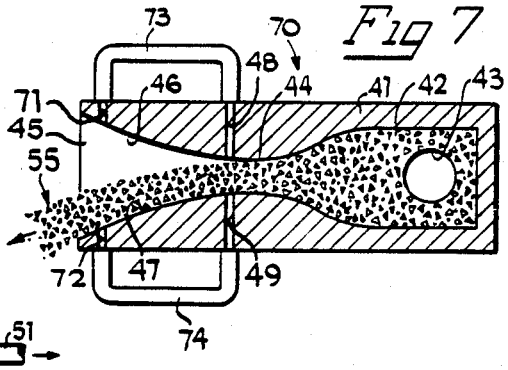

METHOD AND APPARATUS FOR PROVIDING OSCILLATING CONTAMINANT-REMOVAL STREAM

BACKGROUND OF THE INVENTION

This invention relates to a method and apparatus for fluid lancing suitable for use in removing contaminants from surfaces. The invention has particular application to removal of sludge deposits on the tube sheet of a vertical tube heat exchanger, such as in a nuclear steam generator.

A typical nuclear steam generator comprises a vertically oriented shell and a plurality of tubes disposed in the shell so as to form a tube bundle. The tubes may be of inverted U-shape or straight, depending upon the type of generator. In the former type each tube has a pair of elongated vertical portions interconnected at the upper end by a curved bight portion, so that the vertical portions of each tube straddle a center lane or passage through the tube bundle. The tubes may be dimensioned and arranged in either "square pitch" or "triangular pitch" array, so that, on each side of the center lane or passage, the vertical tube portions are disposed in a regular array of parallel rows separated by lanes and parallel columns separated by channels, with the lanes and channels intersecting each other.

A tube sheet supports the vertical portions of the tubes at their lower ends. In the case of U-shaped tubes, the vertical tube portions on one side of the center lane are connected to a primary fluid inlet plenum and those on the other side of the center lane are connected to a primary fluid outlet plenum. The primary fluid, having been heated by circulation through the reactor core, enters the steam generator through the primary fluid inlet plenum, is transmitted through the tube bundle and out the primary fluid outlet plenum. At the same time, a secondary fluid or feedwater is circulated around the tubes above the tube sheet in heat transfer relationship with the outside of the tubes, so that a portion of the feedwater is converted to steam which is then circulated through standard electrical generating equipment.

Sludge, equipment in the form of iron oxides and copper compounds along with traces of other metals, settle out of the feedwater onto the tube sheet. The sludge deposits provide a site for concentration of phosphate solution or other corrosive agents at the tube walls that can result in tube or tube sheet damage, such as pitting, corrosion, cracking, denting or thinning. Accordingly, the sludge must be periodically removed.

One known method for removal of the sludge is referred to as the sludge lance-suction method. Sludge lancing consists of using high pressure water to break up and slurry the sludge in conjunction with suction and filtration equipment that remove the water-sludge mixture for disposal or recirculation. A lance emits a high-velocity water jet or stream substantially perpendicular to the movement of the lance, i.e. parallel to the rows of tubes.

In operation, the water jet breaks up the sludge deposits and moves them toward the periphery of the tube sheet. It is desirable that the water jet have a sufficiently high velocity to dislodge the sludge deposits and move them as far as possible toward the edge of the tube sheet. However, the water velocity cannot be made too high or else it will endanger the tubes. Thus it is desirable that the water jet be effective over a maximum distance without unduly increasing the velocity of the water in the jet.

SUMMARY OF THE INVENTION

It is a general object of this invention to provide an improved sludge lancing system which maximizes the effectiveness of the water jet emitted from the sludge lance for a given water velocity.

In connection with the foregoing object, it is another object of this invention to provide an improved sludge lancing system of the type set forth, which provides for a variable-direction water jet.

Still another object of the invention is the provision of an improved method for removing sludge which utilizes a variable-direction stream of cleaning fluid.

These and other objects of the invention are attained by providing in a system for removing contaminant deposits from a surface, including a lance having a nozzle for directing a stream of cleaning fluid along an axis toward the deposits for dislodging same, the improvement comprising: direction changing means carried by the lance and cooperating with the nozzle for varying the direction of the stream of cleaning fluid within a range of directions centered about the axis, and control means for cyclically controlling the operation of the direction changing means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 3 is a front elevational view of the sludge lance nozzle of FIG. 2, taken along the line 3—3 therein;

FIG. 4 is a further enlarged fragmentary view in horizontal section taken along the line 4—4 in FIG. 3;

FIG. 5 is a diagrammatic view of the control means for the nozzle of FIG. 4;

FIG. 6 is a view similar to FIG. 4 of an alternative embodiment of the nozzle of the present invention; and FIG. 7 is a view similar to FIG. 4 of still another embodiment of the nozzle of the present invention.

DESCRIPTION OF THE PREFERRED EMBODIMENTS

Figure 1:
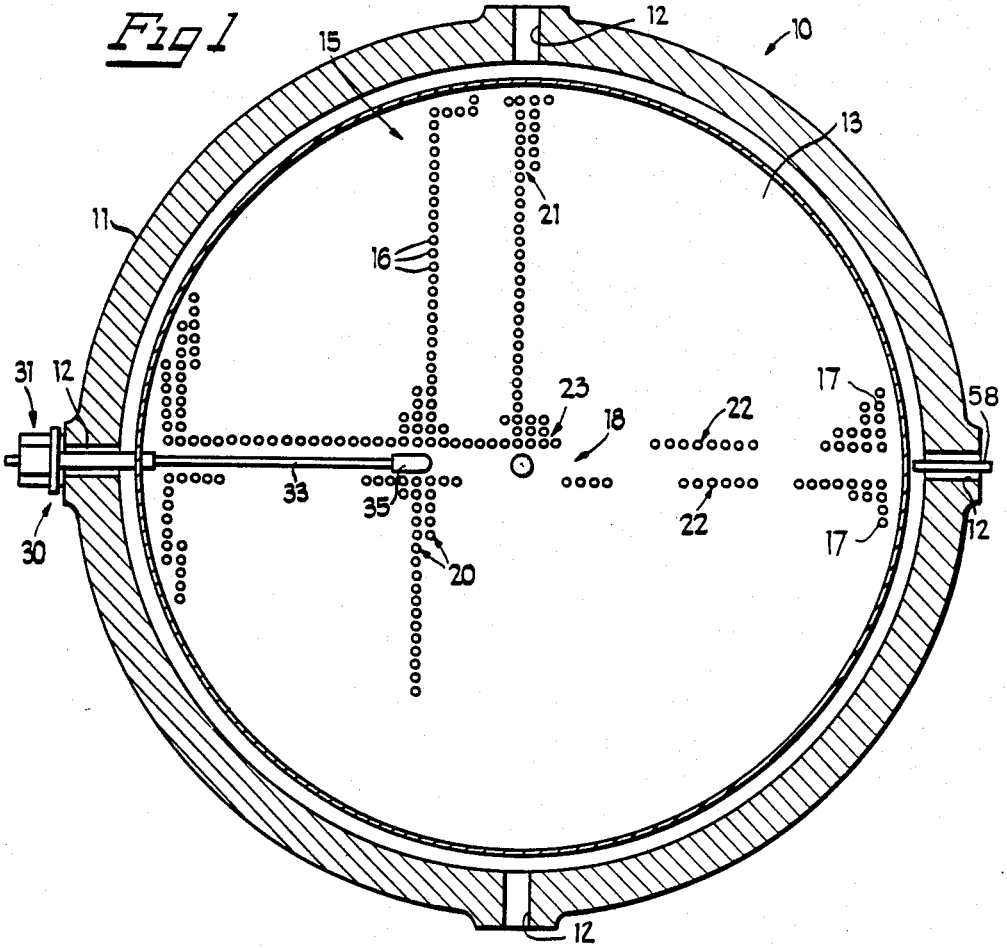
FIG. 1 is a view in horizontal section through a nuclear steam generating vessel, taken just above the tube sheet, and illustrating a fluid lance mounted in lancing position and incorporating a nozzle constructed in accordance with and embodying the features of the present invention.
Figure 2:
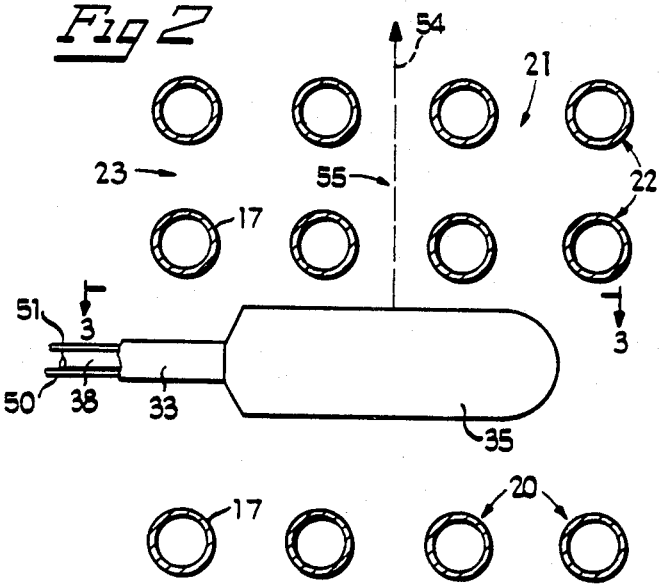
FIG. 2 is an enlarged fragmentary view of a portion of FIG. 1, including the lance nozzle.

Referring to FIGS. 1 and 2, there is illustrated a nuclear steam generator vessel, generally designated by the numeral 10, which includes an elongated, generally cylindrical wall 11 provided with handholes or inspection ports 12 therethrough around the circumference thereof. Extending across and closing the vessel 10 adjacent to the lower end thereof is a circular tube sheet 13, on which is mounted a tube bundle, generally designated by the numeral 15. The tube bundle 15 includes a plurality of heat transfer tubes 16 which may number about 7,000 and each of which is generally in the shape of an inverted U. Each tube 16 has a pair of vertical tube portions 17 which straddle a center tube lane 18 extending diametrically across the tube sheet 13. The lower ends of each of the vertical tube portions 17 are inserted in complementary openings through the tube sheet 13 and communicate with inlet and outlet plenums (not shown) in the vessel 10 beneath the tube sheet 13, all in a well known manner.

Each of the tubes 16 is substantially circular in transverse cross section. The tubes 16 are arranged in an array of parallel rows 20 and columns 22, the rows 20 being separated by inter-row lanes 21 and the columns 22 being separated by inter-column channels 23.

There is mounted on the nuclear steam generator vessel 10 a fluid lance, generally designated by the numeral 30, for the purpose of removing sludge which builds up on the tubesheet 13 between the rows and columns of tubes 16. The fluid lance 30 is mounted on the wall 11 adjacent to one of the handholes 12, as is best illustrated in FIG. 1, and includes mounting and drive apparatus, generally designated by the numeral 31, which may be substantially like that disclosed in U.S. Pat. No. 4,273,076. The disclosure of that patent is incorporated herein by reference, so that only so much of the structure of the fluid lance 30 as is necessary for an understanding of the present invention will be described in detail herein.

The fluid lance 30 includes an elongated tubular arm 33, which is extended through the handhole 12 coaxially therewith, substantially radially of the tube sheet 13 along the center tube lane 18. Fixedly secured to the arm 33 at its distal end is a head 35.

Referring also to FIGS. 3–5 of the drawings, in use a supply of cleaning fluid, such as water, is applied to the fluid lance 30 through an inlet conduit 36. The cleaning fluid is pressurized by a pump 37 and fed therefrom by a conduit 38 along the arm 33 to the head 35. Disposed in the head 35 is a nozzle, generally designated by the numeral 40, which includes a hollow body 41 having formed therein at the rear end thereof a chamber 42 which communicates with the conduit 38 via a port 43. The chamber 42 inturn communicates with a narrow neck or throat 44, which opens into an outlet region 45 bounded by diverging wall portions 46 and 47. Formed in the body 41 are two narrow control channels 48 and 49 which are disposed substantially in lateral alignment with each other and communicate with the neck 44, respectively at opposite sides thereof.

Respectively communicating with the control channels 48 and 49 are control conduits 50 and 51 which extend through the tubular arm 33 alongside the conduit 38. The conduits 50 and 51 respectively terminate at the outlet ports of a fluidic oscillator 52, which is preferably disposed externally of the nuclear steam generator vessel 10, with the mounting and drive apparatus 31. The inlet port of the fluidic oscillator 52 is coupled to the outlet of pump 37 by a conduit 53. The nozzle 40 has a discharge axis 54. In operation, cleaning fluid is pumped from the pump 37 along the conduit 38 to the chamber 42 and then outwardly through the neck 44 for discharge in a stream or jet 55 from the outlet region 45.

In operation, the jet efflux of the discharge stream 55 enters the wide-angle outlet region 45 and stabilizes by flowing along one or the other of the wall portions 46 or 47. When the stream 55 has thus stabilized, for example along the wall portion 47, as illustrated in FIG. 4, a relatively small pressure differential across the neck 44 can cause the stream 55 to detach itself from the wall portion 47 and reattach to flow along the other wall portion 46. The fluidic oscillator 52 operates to alternately apply a pressurized control stream to the control conduits 50 and 51 in an oscillating manner. Thus, when the control stream is applied to the conduit 51, it is directed at the stream 55 flowing along the wall portion 47, causing it to detach and move to the other wall portion 46, thereby sweeping the fluid stream 55 through a range of directions from a lower boundary L to an upper boundary U, as indicated in FIG. 4. A predetermined short time later, the control stream is applied to the conduit 50, for again causing the fluid stream 55 to sweep back to the wall portion 47. In this manner, the jet stream 55 of cleaning fluid oscillates or "jitters" back and forth through separated direction changes to provide an enhanced cleaning action. The effectiveness of this oscillating stream in moving dislodged sludge deposits is due to the enhanced momentum transfer between the jet stream 55 and the static fluid/particulate mixture of the sludge particles in the cleaning fluid stream.

While in the preferred embodiment, the outlet end of the outlet portion 45 of the nozzle 50 is in the form of a narrow rectangle, resulting in the sweeping of the jet stream 55 in a substantially vertical plane, it will be appreciated that different shapes of nozzles could be provided. Thus, for example, a conical outlet region could be provided to effect a three-dimensional sweeping movement of the jet stream 55 or the nozzle 50 could be oriented to provide a horizontal sweeping. Preferably a suction header 58 is disposed in the handhole 12 at the opposite end of the center tube lane 18 from the lance 30, the cleaning fluid and entrained sludge particles being flowed along the perimeter of the tube sheet 13 for discharge through the suction header 58 in a known manner.

Referring now to FIG. 6 of the drawings, there is illustrated an alternative embodiment of the nozzle, generally designated by the numeral 60. The nozzle 60 includes a body 61 having a chamber 62 at the rear end thereof communicating with the conduit 38 through an inlet port 63. The chamber 62 in turn communicates with a narrow neck or throat 64, which opens into an outlet region 65 having diverging wall portions 66 and 67. Disposed adjacent to the neck 64 is a control vane 68 mounted for pivotal movement on a shaft 69 between two positions, with the tip of the van 68 respectively disposed adjacent to the opposite sides of the neck 64.

The nozzle 60 could be arranged to be bi-stable, with the movement of the vane 68 being controlled by a suitable oscillatory drive mechanism. Alternatively, the nozzle 60 could be arranged for unstable operation. In this latter arrangement, as soon as the jet stream 55 attaches itself to one of the wall portions 66 or 67, the force of the stream of cleaning fluid on the vane 68 causes it to flip to force the jet stream 55 to the opposite side of the nozzle 60.

Referring to FIG. 7 of the drawings, there is illustrated yet another embodiment of the nozzle, generally designated by the numeral 70. The nozzle 70 is similar to the nozzle 40 and like parts bear the same reference numerals.

The nozzle 70 includes two feedback ports 71 and 72 aligned laterally of the nozzle 70 and communicating with the outlet region 45 thereof, respectively along the wall portions 46 and 47. The feedback ports 71 and 72 are respectively coupled to the control channels 48 and 49 by feedback conduits 73 and 74. In operation, when the jet stream 55 is attached to one wall of the outlet region 45, for example the wall portion 47 as illustrated in FIG. 7 a portion of the fluid flow is returned via the feedback conduit 74 and directed against the stream 55 at the neck 44 for deflecting the stream to the other wall portion 46, where a like feedback phenomenon causes the jet stream 55 to again be deflected back to the wall portion 47. The oscillatory frequency is, in general, inversely proportional to the length of the feedback paths.

From the foregoing it can be seen that there has been provided an improved sludge removal system and method, wherein the sludge lance emits a jet stream which is jittered or oscillated back and forth to enhance the effect thereof in moving the dislodged sludge particles along the tube sheet 13.

We claim:

1. In a system for removing contaminant deposits from a surface, including a lance for emitting a stream of cleaning fluid along an axis toward the deposits for dislodging same, the improvement comprising: a nozzle carried by the lance for forming and directing the stream of fluid, said nozzle having a fluid passage including a wide inlet portion and a narrow neck portion and outlet walls diverging at a continuously increasing angle starting at the narrow neck portion and defining an outlet portion and having a discharge axis, said stream of fluid being emitted from said outlet portion and having a width substantially less than the maximum width of said outlet portion between said diverging walls, and direction changing means in said nozzle for continuously varying the direction of the stream of fluid throughout a range of directions centered about said discharge axis and limited by said diverging walls of said outlet portion, said direction changing means including feedback means for deriving two diverting fluid streams from the stream of cleaning fluid at locations on opposite sides of said diverging walls of said outlet portion intermediate the ends of said diverging walls and directing the diverting fluid streams respectively against opposite sides of the stream of cleaning fluid at said neck portion.

2. The system of claim 1, wherein said direction changing means effects movement of the stream of cleaning fluid through a substantially planar range of movement.

3. The system of claim 2, wherein said stream of cleaning fluid is moved in a plane substantially vertical to the surface being cleaned.

4. The system of claim 1, wherein said control means includes means cooperating with said direction changing means for effecting an oscillatory movement of the stream of cleaning fluid.

5. The system of claim 4, wherein said control means includes a fluidic oscillator.

6. A sludge lancing system for removing sludge deposits from a tube sheet of a nuclear steam generating vessel, said system comprising: a lance having a nozzle for directing a stream of cleaning fluid along an axis toward the deposits for dislodging same, said nozzle having a fluid passage including a wide inlet portion and a narrow neck portion and outlet walls diverging at a continuously increasing angle starting at the narrow neck portion and defining an outlet portion, said stream of fluid being emitted from said outlet portion and having a width substantially less than the maximum width of said outlet portion between said diverging walls, direction changing means carried by said lance and cooperating with said nozzle for continuously varying the direction of the stream of cleaning fluid throughout a range of directions centered about said axis and limited by said diverging walls of said outlet portion, said direction changing means including means for deriving two diverting fluid streams from said stream of cleaning fluid and directing said diverting streams respectively against opposite sides of said stream of cleaning fluid to deflect the stream of cleaning fluid, said direction changing means including fluid oscillator means for cyclically controlling the operation of said changing means.

* * * * *